US005666614A

United States Patent [19]

Kuramochi et al.

[11] Patent Number: 5,666,614

[45] Date of Patent: Sep. 9, 1997

[54] LIQUID DEVELOPMENT APPARATUS FOR ELECTROSTATIC LATENT IMAGE USING A PLURALITY OF ELECTRODES

[75] Inventors: Satoru Kuramochi; Masayuki Iijima, both of Tokyo, Japan

[73] Assignee: Dai Nippon Printing Co., Ltd., Tokyo, Japan

[21] Appl. No.: 457,628

[22] Filed: Jun. 1, 1995

Related U.S. Application Data

[62] Division of Ser. No. 84,518, Jun. 29, 1993, Pat. No. 5,477,313.

[30] Foreign Application Priority Data

| | | | |
|---|---|---|---|
| Jun. 30, 1992 | [JP] | Japan | 4-173031 |
| Jun. 30, 1992 | [JP] | Japan | 4-173032 |
| Jun. 30, 1992 | [JP] | Japan | 4-173033 |
| Jun. 30, 1992 | [JP] | Japan | 4-173034 |

[51] Int. Cl.[6] ..... G03G 15/01

[52] U.S. Cl. ..... 399/233; 399/240

[58] Field of Search ..... 355/256, 257, 355/258, 326 R, 327; 118/659, 660; 430/117; 399/233, 240

[56] References Cited

U.S. PATENT DOCUMENTS

| | | | |
|---|---|---|---|
| 3,601,092 | 8/1971 | Satomi | 118/661 |
| 3,900,003 | 8/1975 | Sato et al. | 355/256 |
| 3,931,792 | 1/1976 | Sato | 355/256 |
| 3,980,404 | 9/1976 | Townsend | 355/256 |
| 3,981,576 | 9/1976 | Inoue | 355/327 |
| 3,991,711 | 11/1976 | Nakano et al. | 355/256 |
| 4,245,023 | 1/1981 | Cassiers et al. | 118/661 X |
| 4,264,185 | 4/1981 | Ohta | 355/326 R |
| 4,325,627 | 4/1982 | Swidler et al. | 118/651 X |
| 4,327,664 | 5/1982 | Ohkawa et al. | 118/661 |
| 4,373,469 | 2/1983 | Kuge et al. | 355/256 |
| 4,410,260 | 10/1983 | Kuehnle | 355/256 |
| 4,707,112 | 11/1987 | Hartmann | 355/256 |
| 4,833,500 | 5/1989 | Mochizuki et al. | 355/256 |
| 4,923,581 | 5/1990 | Day | 118/645 |

FOREIGN PATENT DOCUMENTS

| | | |
|---|---|---|
| 0074083 | 4/1988 | Japan . |

*Primary Examiner*—Robert Beatty
*Attorney, Agent, or Firm*—Dellett and Walters

[57] ABSTRACT

A liquid development and transfer apparatus includes a plurality of applicators for supplying developing solution uniformly to the surface of an electrostatic latent image. A voltage opposite in polarity to the electrostatic latent image is applied to one applicator and a voltage the same polarity as the latent image is applied to the other applicator. At least one of the applicators is a dish type development electrode. After development of the electrostatic latent image for a given color on the electrostatic latent image carrier, solvent contained in the developed image layer is removed or heated, and color superimposing development is performed consecutively in similar fashion for other colors. By collectively transferring the resulting developed image to a recording paper or an intermediate transfer medium, color superimposing development can be accomplished with high accuracy without mixing of the colors of the developing solutions.

3 Claims; Drawing Sheets

FIG. 15
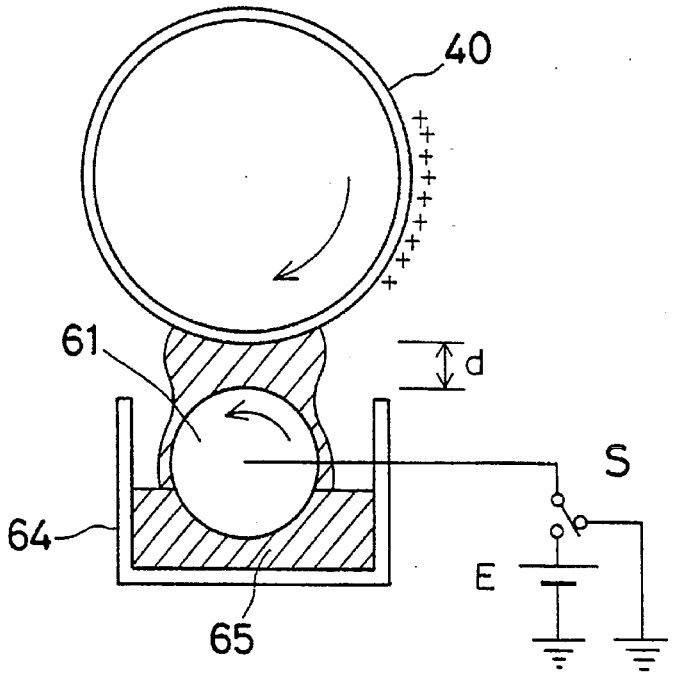
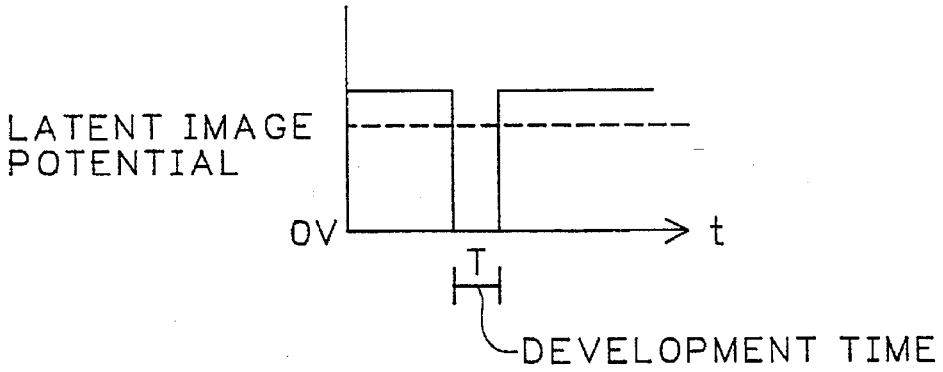
FIG.16
——— VOLTAGE APPLIED ON ROLLER ELECTRODE
----- LATENT IMAGE POTENTIAL FIG.27(a)
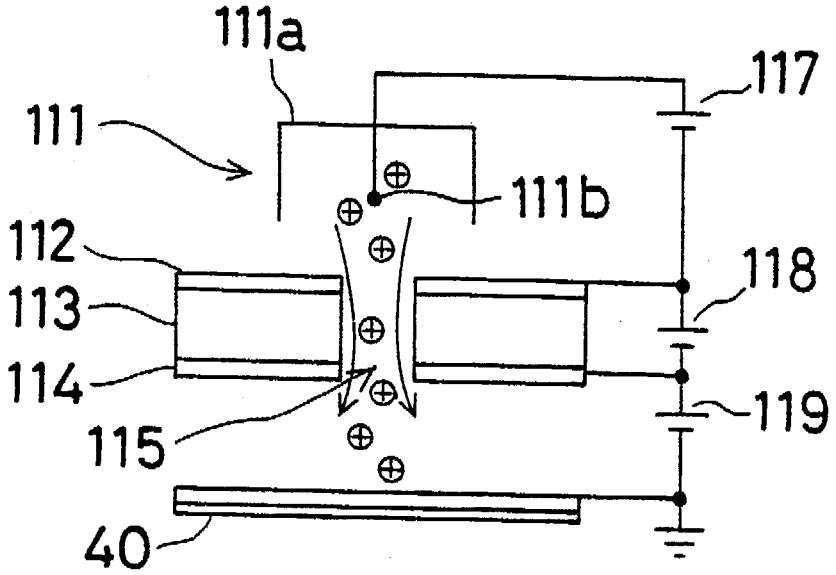
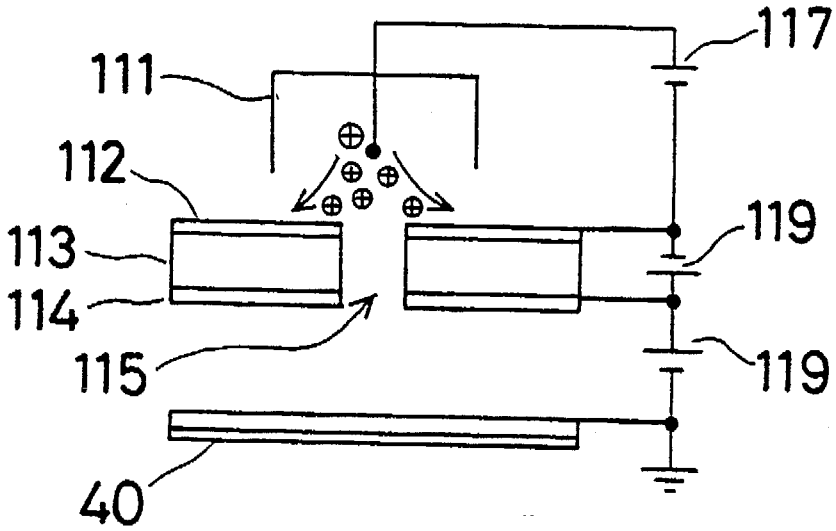
FIG.27(b)

LIQUID DEVELOPMENT APPARATUS FOR ELECTROSTATIC LATENT IMAGE USING A PLURALITY OF ELECTRODES

This is a divisional of application Ser. No. 08/084,518 filed on Jun. 29, 1993, now U.S. Pat. No. 5,477,313.

BACKGROUND OF THE INVENTION

The present invention relates to a liquid development apparatus and a liquid development and transfer apparatus for electrostatic latent image, in which toner particles with electric charge are suspended in an insulating liquid and development is performed by applying an electric field between the electrostatic latent image and development electrodes.

Description is given on the liquid development method referring to FIG. 1. A developing solution 3 is filled between a conductive development roller 1 and a dielectric layer or a photosensitive layer 2 where a latent image 5 is formed. In the developing solution 3, charged toner particles 4 having opposite polarity to the latent image charge are suspended in an insulating liquid. By an electric field created by the latent image charge 5, the charged toner 4 is attracted and development is performed. In this case, by short-circuiting between the dielectric layer or the photosensitive layer 2 and the development roller 1 to bring them to the same potential, electric field strength E in the developing solution is increased to attain effective development. By shortening the distance L to the dielectric layer or the photosensitive layer 2, the electric field strength E can be increased; however, if the distance L is too short, the quantity of the developing solution 3 decreases, and this leads to insufficient development. Thus, the distance L must be set to an optimal length.

More concretely, the liquid development apparatus of FIG. 1 is divided into two types: the one having a dish development electrode shown in FIG. 2 and the one having a rotating roller type development electrode shown in FIG. 3.

In the apparatus shown in FIG. 2, a dish type development electrode 11 is arranged face-to-face to a cylindrical electrostatic latent image carrier 10, and a fluid developer 12 is placed between them. Voltage with the same polarity as the electrostatic latent image from a bias power source 13 is applied on the development electrode 11 to prevent development (fogging) on the portion where latent image is not formed.

In the apparatus shown in FIG. 3, an application roller 20 is arranged face-to-face to an electrostatic image carrier 10, and voltage with the same polarity as the electrostatic latent image from a bias power source 13 is applied on the application roller 20. A fluid developer is injected on the application roller from a developer supply unit 21 in the form of nozzles, and the developer is supplied to the electrostatic latent image carrier 10 by the application roller. The application roller 20 may be immersed in the fluid developer 23, which is filled in a container 22, so that the developer may be supplied by rotating the roller.

In the apparatus shown in FIG. 2, bias voltage is applied to prevent development on the portion an electrostatic latent image is not formed, but toner is electrodeposited on the surface of the development electrode 11 by bias voltage, thereby reducing the electrodes effectiveness and gathering the toner at a lower position as shown by the reference numeral 14. The toner gathered on the development electrode side provides an inverse bias voltage for a certain period of time up to the next development starting after the completion of the present development and builds up toward the electrostatic latent image carrier 10. Normally, the toner can be removed by cleaner; however, if the toner is dried and solidified on the electrostatic latent image carrier 10, it is not very easy to clean up. The closer the development electrode 11 is placed to the electrostatic latent image carrier, the more development is promoted. On the other hand, if the quantity of the developing solution is decreased or if the electrode is too close to the carrier, the developing solution forms a meniscus between the development electrode and the electrostatic latent image carrier, and the discharge is hindered. If this is dried and solidified, it is not very easy to clean it up.

In the apparatus shown in FIG. 3, it is possible to mechanically remove the toner attached on the application roller 20 by a blade 24. However, if the development apparatus is arranged in a transverse direction to the electrostatic latent image carrier 10 or if there is not a very wide space, it is difficult to uniformly provide the developing solution on the roller surface and to evenly supply the developing solution to the surface of the electrostatic latent image.

Thus, in the liquid development apparatus, DC bias voltage with the same polarity as the electrostatic latent image is applied on the development electrode to prevent development (fogging) due to residual potential on the electrostatic latent image. However, on the portion where the electrostatic latent image is not formed, the developer is electrodeposited on the development electrode due to DC bias voltage. As the result, the electric field on that portion is weakened, and this causes difficulties such as stripes or blurs. For this reason, in case of the dish type development electrode, bias voltage with the opposite polarity to the electrostatic latent image is applied for a limited duration to clean up the electrodeposited developer, while, when the electrostatic latent image is continuously formed, bias voltage of the opposite polarity cannot be applied. In case of the rotating roller type development electrode, it is possible to mechanically remove the electrodeposited developer by a doctor blade, but it is not possible to have a long developing time as in the case of the dish type electrode.

FIG. 4 shows a liquid development and transfer apparatus, in which an application roller 20 with bias voltage applied on it is arranged face-to-face to an electrostatic latent image carrier 10, and a fluid developer is injected to the application roller by a developer supply unit 21 in form of nozzles, and the developer is supplied to the electrostatic latent image carrier 10 by the application roller. Or, the application roller 20 may be immersed in a fluid developer 23, which is filled in a container 22, and the developer may be supplied by rotating the roller. After developing in this way, a recording paper 26 is pressed on the surface of the electrostatic latent image carrier 10 by a transfer unit 25, and the developed electrostatic latent image is transferred to the recording paper 26.

When a wet type development unit for each color is arranged in order to obtain a full-color image using the liquid development and transfer apparatus as shown in FIG. 4 and multicolor superimposing development is performed on the surface of the electrostatic latent image carrier and it is transferred to the recording paper or to a transfer intermediate medium, developing solution for each color may be mixed in some cases, in case the electrostatic latent image carrier consists of a photosensitive member having a photoconductive layer, it is necessary to perform exposure for another color through the developer layer of the color which has been developed already. In such case, it is very difficult to carry out color superimposing development on the photoconductive layer because light absorption by the developer layer occurs.

FIG. 5 shows a conventional type multicolor liquid development apparatus using development rollers. Development units 30 for each of 4 colors of Y, M, C and K are arranged face-to-face to an electrostatic latent image carrier 10, and these units independently move up and down with respect to the electrostatic latent image carrier 10 as shown by arrows B. Thus, multicolor superimposing development is performed by moving the development unit 30 up and down for each color. Each of the development units 30 is provided with one or more application rollers 30*a*. Squeeze rollers 30*b* are provided to make pairs with the application rollers, and solvent in excess for each color is recovered. It is needless to say that hi. as voltage with the same polarity as the latent image formed on the surface of the electrostatic latent image carrier 10 is applied on the application roller 30*a* as in the case of FIG. 4, and bias voltage is also applied on the squeeze roller 30*b* to scrape off the toner, which has not been used for development.

However, in the multicolor development apparatus of FIG. 5, the development rollers and the squeeze roller are arranged in pairs. Thus, as many squeeze rollers as the number of colors are needed. This requires the apparatus of large size, making it difficult to install in small space. Also, it is necessary to keep a constant distance between the squeeze rollers and the electrostatic latent image carrier, but it is difficult to keep constant distance because the squeeze rollers are moved together with the ascending or descending development rollers.

SUMMARY OF THE INVENTION

The present invention has been conceived to solve the above problems.

It is an object of the present invention to remove a developer electrodeposited on a development electrode in a liquid development apparatus in an easy and reliable manner.

It is another object of the present invention to increase the degree of freedom in the liquid development apparatus and to produce it in a compact design.

It is still another object of the present invention to ensure a uniform supply of the developing solution to the surface of an electrostatic latent image.

It is another object of the invention to make development time longer.

It is a further object of the invention to provide the apparatus in compact design and to keep a constant distance between the squeeze roller and the electrostatic latent image carrier.

It is still another object of the invention to perform multicolor superimposing development and transfer with high accuracy and to prevent mixing of the developing solution of different colors.

To attain the above objects, the present invention provides s liquid development apparatus for developing by a rotating roller type development electrode using a liquid developer, wherein there are provided an application roller for supplying the developing solution to an electrostatic latent image carrier where an electrostatic latent image is formed and developing solution supply means for evenly supplying the developing solution on the surface of the application roller.

Also, the present invention is characterized in that the developing solution supply means is a metering roller arranged closer to or in contact with the application roller, and the application roller and the metering roller have irregular surfaces.

Also, the present invention is characterized in that nozzles or slits for injecting the developing solution to the surface of the application roller are arranged at closer positions.

Also, the present invention is characterized in that there are provided a DC bias power source applying forced bias voltage on the application roller and an AC bias power source for applying AC bias voltage between the application roller and the developing solution supply means.

The present invention provides a liquid development apparatus comprising an electrostatic latent image carrier where an electrostatic latent image is formed and a plurality of development electrodes are arranged face-to-face to the electrostatic latent image carrier, wherein bias voltage with opposite polarity to the electrostatic latent image is applied on at least one of said plurality of development electrodes and bias voltage of the same polarity as the electrostatic latent image is applied on the other development electrodes.

Also, the present invention is characterized in that at least one of said plurality of development electrodes is a dish type development electrode, bias voltage with opposite polarity to the electrostatic latent image is applied on at least one of said dish type development electrodes, bias voltage with the same polarity as the electrostatic latent image is applied on at least one of said development electrodes, and at least one of the development electrodes is a rotating roller type development electrode.

Further, the present invention provides a liquid development apparatus, comprising an electrostatic latent image carrier where an electrostatic latent image is formed and a plurality of development electrodes are arranged face-to-face to the electrostatic latent image carrier, wherein the length of the electrostatic latent image carrier in the moving direction in an effective development area formed by the surface of the electrostatic latent image carrier and a plurality of development electrodes is longer than the product of minimum time required for development and the moving velocity of the electrostatic latent image carrier surface.

Also, the present invention provides a liquid development apparatus for developing an electrostatic latent image surface by developing solutions of two or more colors, whereby there are provided a plurality of development units for supplying the developing solution of two or more colors to the surfaces of the electrostatic latent image and at least one solvent recovery means being arranged independently from each of the development units and used for recovering excessive solvent on the surface of the electrostatic latent image.

Also, the present invention is characterized in that said plurality of development units are movable, the developing solutions are supplied closer to the electrostatic latent image surface for each color, said solvent recovery means is arranged at a fixed position with respect to the electrostatic latent image surface commonly to all colors, and said solvent recovery means consists of rotating rollers for scraping off excessive solvent on the surface of the electrostatic latent image.

Also, the present invention provides a liquid development and transfer apparatus, in which an electrostatic latent image carrier where an electrostatic latent image is formed and a liquid development unit are arranged face-to-face to each other, development is performed on the surface of the electrostatic latent image carrier and the development image is transferred on a recording paper, whereby liquid development units for two or more colors are disposed, and after developing the image in each color, the image is transferred on the recording paper or a transfer intermediate medium.

Also, the present invention is characterized in that the electrostatic latent image carrier has a layer structure where at least a conductive layer and a dielectric layer are laminated one over the other on a support member, and the electrostatic latent image is formed on the electrostatic latent image carrier surface by an ion printer.

Further, the present invention is characterized in that development and solvent removal are performed for each color on the electrostatic latent image carrier surface, and the developed image transferred together on a recording paper or a transfer intermediate medium, the electrostatic latent image carrier is a continuous body, and development, solvent removal and transfer can be repeatedly performed.

BRIEF DESCRIPTION OF THE DRAWINGS

FIG. 15 is a drawing for explaining minimum development time required for the liquid development apparatus;

FIG. 16 is a diagram for explaining minimum development time required for the liquid development apparatus;

FIGS. 27(*a*)–27(*b*) show an example of colotron discharge type ion printer.

DESCRIPTION OF THE PREFERRED EMBODIMENTS

Figure 6:
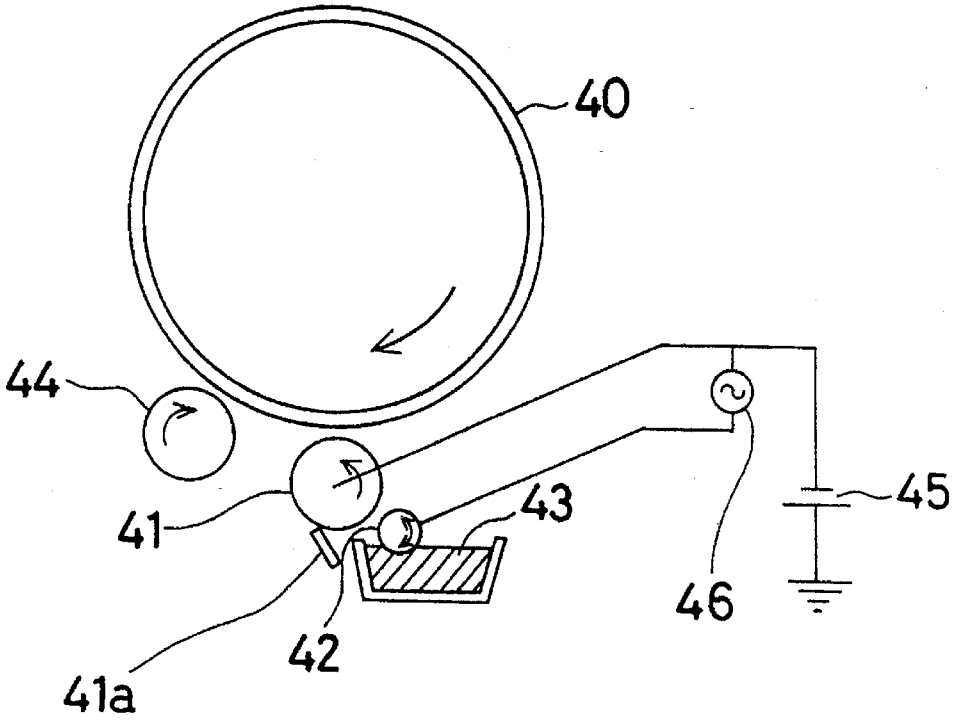
FIG. 6 shows an embodiment of the liquid development apparatus of the present invention.

FIG. 6 shows an embodiment of a liquid development apparatus of the present invention, in which reference numeral 40 represents an electrostatic latent image carrier, 41 an application roller, 41*a* a blade, 42 a metering roller, 43 a liquid developer, 44 a squeeze roller, 46 an AC bias power source, and 45 a DC bias power source.

An electrostatic latent image is formed on the surface of the electrostatic latent image carrier 40, and it is rotated in the direction of the arrow. The application roller 41 is rotating without being in contact with the electrostatic latent image carrier 40 and supplies developing solution to the surface of the electrostatic latent image. The metering roller 42 is brought into contact with the liquid developer and comes closer to or in contact with the application roller 41 and evenly supplies the developing solution to the roller surface. The squeeze roller 44 arranged closer to the electrostatic latent image carrier 40 is used for scraping off excessive solvent.

Figure 7:
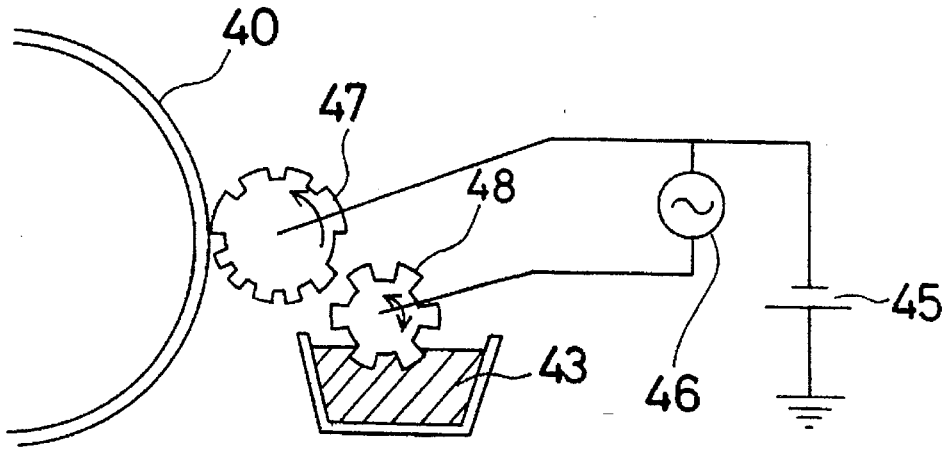
FIG. 7 shows another embodiment of the liquid development apparatus of the present invention.

In the arrangement as described above, an electric field generated by the electrostatic latent image is formed between the electrostatic latent image carrier 40 and the application roller 41, and a charged toner in the liquid developer 43 is attracted toward the electrostatic latent image surface and development is performed. In this case, DC bias voltage with the same polarity as the electrostatic latent image is applied on the application roller 41 from a bias power source 45. Thus, the portion of the electrostatic latent image carrier 40 where electrostatic latent image is not formed is prevented from being developed, and fogging by residual potential is prevented. For this reason, on the portion without electrostatic latent image, the developer is electrodeposited on the application roller 41. The quantity of the developer supplied to the application roller 41 can be changed as desired by adjusting the gap between the application roller 41 and the metering roller 42 and by changing the rotating speed, and the developer is evenly provided on the surface of the application roller. By applying AC voltage from an AC power source 46 between the application roller 41 and the metering roller 2, the developer electrodeposited on the application roller can be removed in non-contact manner by alternating electric field, and the developer electrodeposited on the metering roller 42 is also removed at the same time. It is also possible to mechanically remove the electrodeposited toner by arranging a blade 41*a* on the application roller 41. Also, the developer electrodeposited on the squeeze roller can be removed in non-contact manner by disposing the metering roller face-to-face to the squeeze roller 44 and by applying AC voltage between these two. FIG. 7 represents another embodiment of the present invention similar to FIG. 6, except that the application roller 47 and the metering roller 48 have irregular surfaces. The roller surface may be regular or irregular, and the degree of irregularities may be determined as desired according to the gap required between the electrostatic latent image surface and the application roller 6. In the present embodiment, when the developer is electrodeposited by bias voltage on the application roller 6, it is not possible to mechanically remove it due to the irregular surface of the roller. However, by applying AC voltage from an AC power source 46 to the metering roller 48, the developer electrodeposited on the application roller 47 and the metering roller 48 can be removed in non-contact manner by the alternating electric field.

Figure 8:
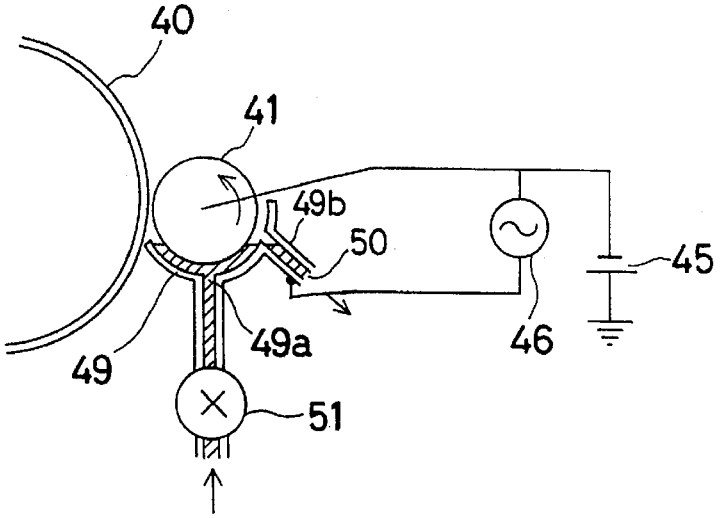
FIG. 8 represents still another embodiment of the liquid development apparatus of the present invention.

FIG. 8 shows another embodiment of the present invention, in which nozzles for injecting the developing solution are arranged at a closer position as the means for supplying developer to the application roller 41.

A developer supply unit 49 is provided with nozzles 49*a* and injects the developer supplied from a pump 51 through the nozzles 49*a* to an application roller 41. The developer supply unit 49 has an outlet 49*b* to discharge the developer when it reaches a certain level, and excessive developer is discharged from the outlet 49*b*. When the developer supply unit 49 is arranged closer to the application roller and the developer is injected through the nozzle 49*a*, the developer is evenly distributed on the surface of the application roller, and the developer can be evenly supplied to the electrostatic latent image carrier 40. The developer electrodeposited on the inner surface of the developer supply unit and on the surface of the application roller 41 can be removed in non-contact manner by the alternating electric field because AC voltage from the AC power source 46 is applied between these two. Therefore, no problem occurs even when the roller and the developer are arranged close to each other.

In this way, the developer is evenly formed on the surface of the application roller and the developing solution can be uniformly supplied on the electrostatic latent image, and development can be performed evenly. By applying forced DC bias voltage on the application roller, fogging due to residual potential can be prevented, and the developer electrodeposited on the application roller and the developer supply unit can be removed in non-contact manner by application of AC voltage. Thus, even when the developer supply unit and the application roller are arranged close to each other, the trouble due to electrodeposition of the developer can be avoided. Because the electrodeposited developer can be removed in a non-contact manner, there is no need to provide a blade, and this contributes to the increase of degree of freedom in the arrangement and compact design of the development apparatus.

Figure 9:
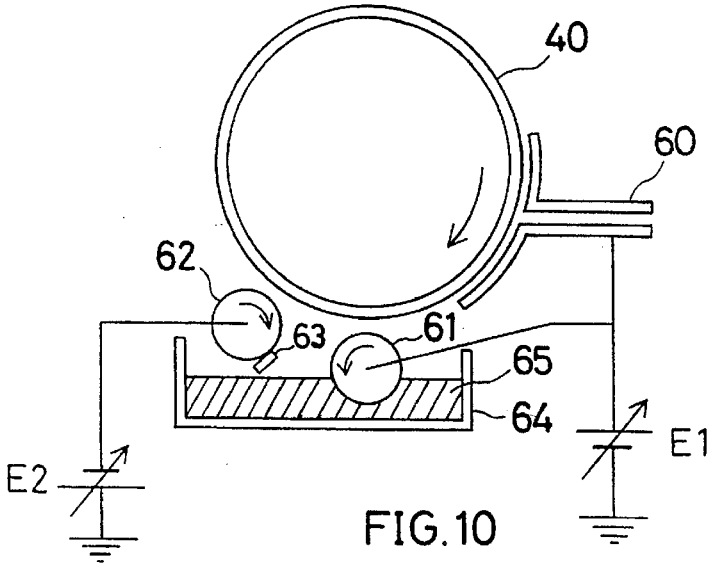
FIG. 9 represents an embodiment of a liquid development apparatus having a dish type development electrode and a roller type electrode.

FIG. 9 shows another embodiment of the present invention having a plurality of development electrodes. In the figure, reference numeral 40 represents an electrostatic latent image carrier, 60 a dish type development electrode, 61 a rotating roller type electrode, 62 a squeeze roller, 63 a blade, 64 a developer container, and 65 a developing solution.

On the surface of the electrostatic latent image carrier 40, an electrostatic latent image is formed, and the carrier is rotating in the direction of the arrow. To a dish type development electrode 60, developing solution is sent from a pump (not shown) through a gap between the electrode and the electrostatic latent image carrier 40 to the surface of electrostatic latent image. A rotating roller type development electrode 61 is rotating with a given distance from the electrostatic latent image carrier to evenly supply the developing solution 65 in a developer container 64 to the surface of the electrostatic latent image carrier 40 and provides development electric field. On the dish type development electrode 60 and the rotating roller type development electrode 61, DC bias voltage with opposite polarity to the electrostatic latent image is applied from a variable voltage power source El. A squeeze roller 62 is arranged close to the electrostatic latent image carrier 40 and scrapes off excessive solvent, and bias voltage with the same polarity as the electrostatic latent image from a variable voltage power source E2 is applied on it.

In the above arrangement, charged toner in the developing solution is attached and developed between the electrostatic latent image carrier 40 and the dish type development electrode 60 as well as the rotating roller type electrode 61 due to an electric field of the electrostatic latent image on the electrostatic latent image carrier 40 and the development electrode. In this case, DC bias voltage with opposite polarity to the electrostatic latent image from the variable voltage power source E1 is applied on the dish type electrode and the rotating roller type electrode. As the result, the electric field between the electrostatic latent image carrier 40 and the development electrode is intensified, and the developer is prevented from being electrodeposited on the development electrode. Thus, it is possible to provide longer developing time for the dish type development electrode and the roller type development electrode, and no electrodeposition occurs on the dish type development electrode.

On the other hand, by application of bias voltage from the variable voltage power source El, the portion without an electrostatic latent image of the electrostatic latent image carrier 40 is developed and fogging occurs. Bias voltage with the same polarity as the electrostatic latent image is applied on the squeeze roller 62 and DC bias voltage with opposite polarity to electrostatic latent image is applied on the development electrode. Thus, the fogging generated on the portion of the carrier 40 without electrostatic latent image is removed by intensified electric field. In the above embodiment, only one of each a dish type development electrode and a roller type development electrode are provided, however it is apparent that two or more of these electrodes may be arranged. In such case, bias voltage with polarity opposite to the electrostatic latent image should be applied on at least one of the dish type electrodes to prevent electrodeposition on the development electrodes.

Figure 10:
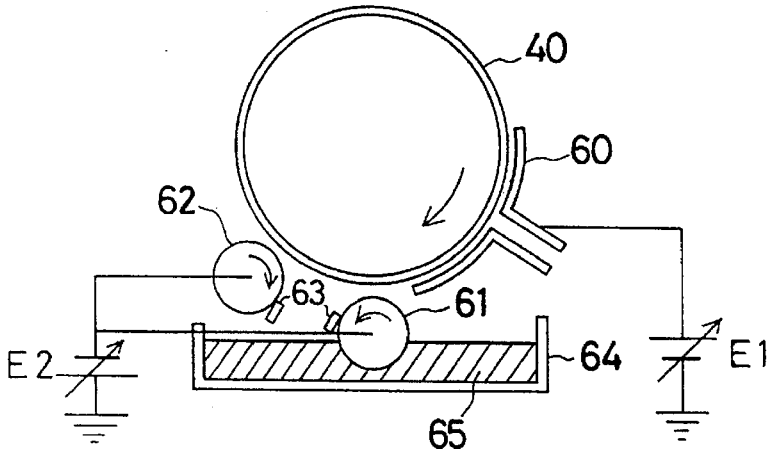
FIG. 10 shows another embodiment having a plurality of development electrodes.

FIG. 10 shows still another embodiment of the present invention, and it is the same as the embodiment of FIG. 9, except that voltage with the same polarity as the electrostatic latent image is applied on the rotating roller type development electrode 61. In this embodiment, developing time can be longer due to the dish type development electrode 60, and electrodeposition on the dish type development electrode can be prevented by application of bias voltage with polarity opposite to the electrostatic latent image. On the other hand, in the rotating roller type development electrode 61 receives a variable bias voltage with the same polarity as the electrostatic latent image to avoid fogging on portions of carrier 40 where the electrostatic latent image is not formed. Since the electrodeposition on the development electrode 61 can be mechanically removed by a blade 63, the advantages of the dish type development electrode 60 and the rotating roller type development electrode 61 can be utilized.

Figure 11:
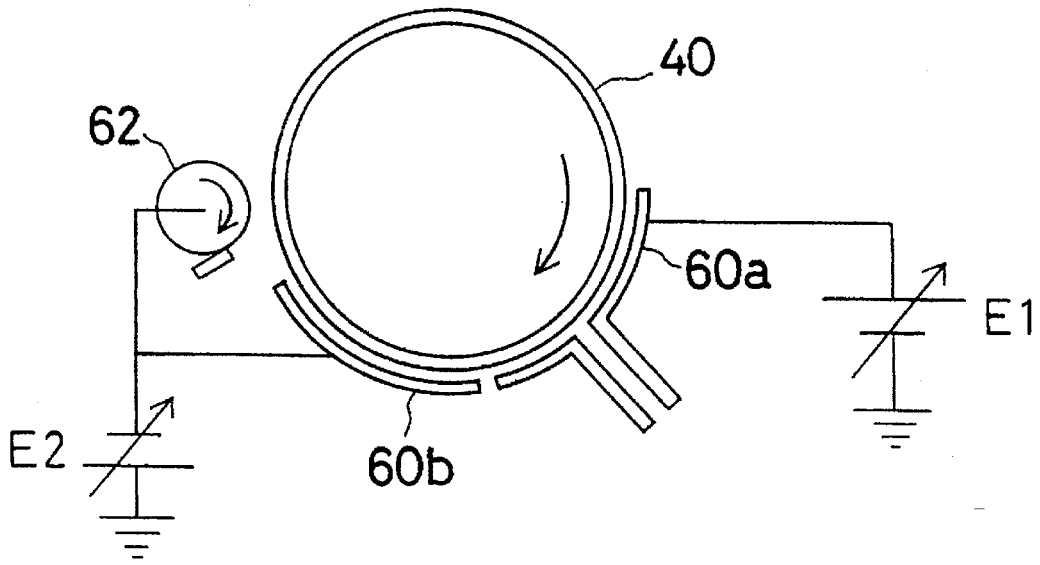
FIG. 11 shows an embodiment having a split dish type development electrode.

FIG. 11 shows an embodiment having a dish type development electrode in split form. In this embodiment, dish type development electrodes 60*a* and 60*b* are arranged face-to-face to an electrostatic latent image carrier 40, and bias voltage with opposite polarity to the electrostatic latent image is applied on one of the dish type development electrodes 60*a*, and bias voltage with the same polarity as the electrostatic latent image is applied on the other dish type development electrode 60*b* as well as on the squeeze roller 62. On the dish type development electrode 60*a*, to which developing solution is supplied from a pump (not shown), bias voltage with opposite polarity to the electrostatic latent image is applied, and thus prevents electrodeposition. Since bias voltage with the same polarity as the electrostatic latent image is applied on the dish type development electrode 60*b*, fogging generated on the portion without electrostatic latent image can be removed by the dish type development electrode 60*a*. The electrodeposition may occur on the dish type development electrode 60*b*, but the electrodeposition can be reduced by adjusting voltage of the variable voltage power source E2.

Figure 12:
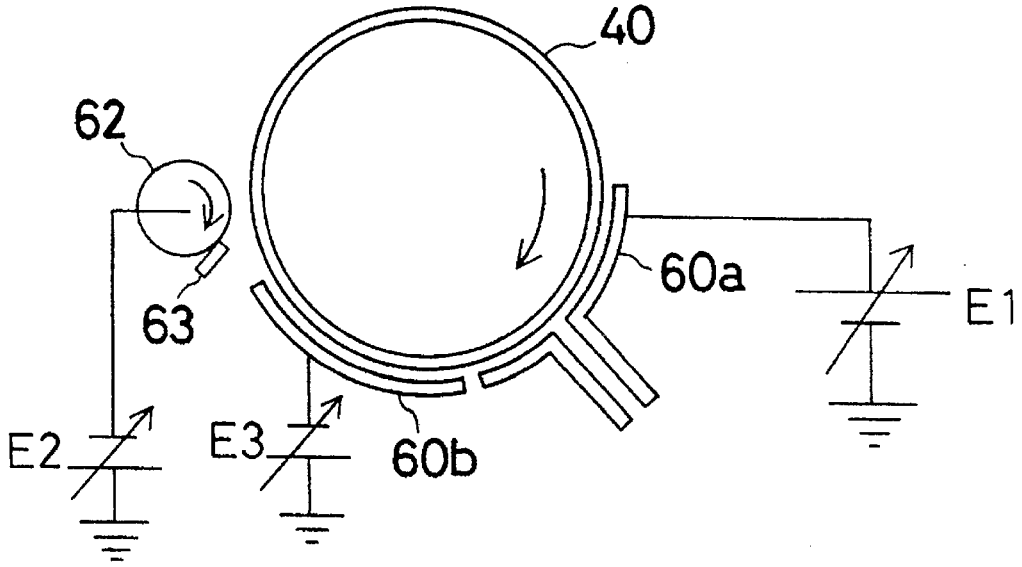
FIG. 12 shows an embodiment where variable voltage is independently applied on a split dish type development electrode.

As shown in FIG. 12, bias voltage may be applied from a variable voltage power source E3 with the same polarity as the electrostatic latent image on the dish type development electrode 60*b* and voltage may be regulated independently from the squeeze roller. In this case, if the applied voltage is made as low as possible, the electrodeposition on the dish type development electrode 60*b* can be reduced.

Figure 13:
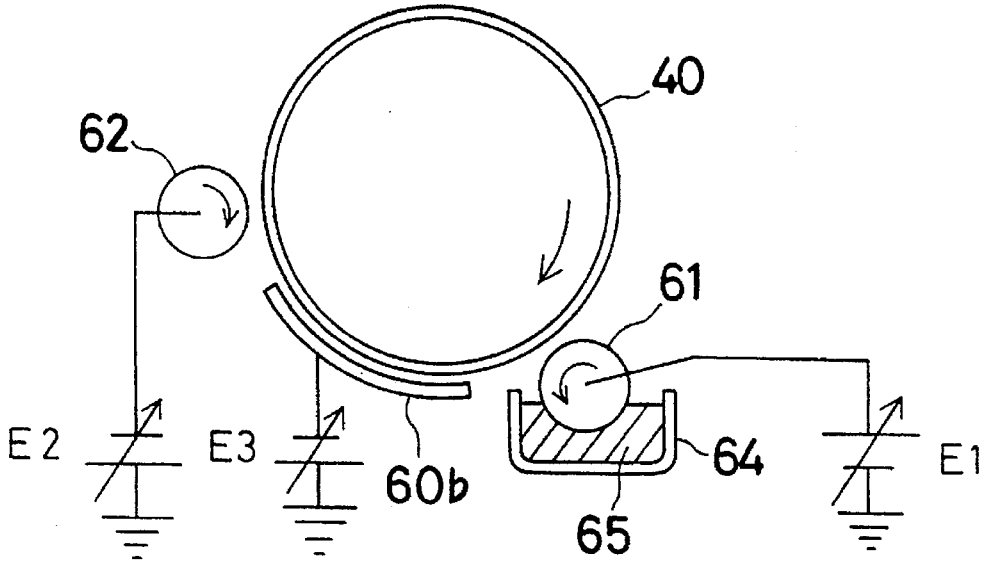
FIG. 13 shows an embodiment where variable voltage is independently applied on a dish type development electrode and a roller type electrode.

FIG. 13 shows another embodiment of the present invention. This embodiment is different from that of FIG. 12 in that a rotating roller type development electrode 61 is arranged instead of the dish type development electrode 6O*a*. It is also possible in this embodiment to have longer developing time by the roller type development electrode and the dish type development electrode, and the electrodeposition to the roller type development electrode 61 can be prevented.

Figure 14:
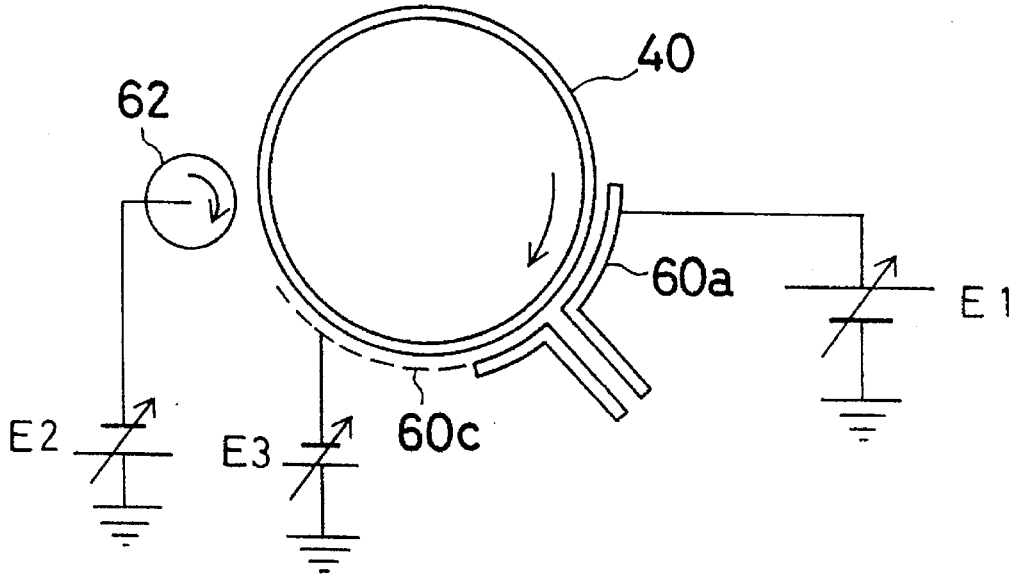
FIG. 14 shows an embodiment where variable voltage is independently applied on a mesh type electrode and a dish type development electrode.

FIG. 14 shows another embodiment of the present invention. Instead of the dish type development electrode 60*b* in FIG. 12, a mesh type electrode 60*c* is used. Because unnecessary developer can be removed by the mesh, development can be performed effectively.

In this way, when the electrostatic latent image carrier surfaces are moved over a plurality of development electrodes and development is performed, bias voltage with opposite polarity to the electrostatic latent image is applied on at least one of a plurality of development electrodes to prevent electrodeposition on the development electrodes. By applying bias voltage with the same polarity as electrostatic latent image on the other development electrodes, it is possible to remove development on the portion without an electrostatic latent image. The use of a plurality of development electrodes provides longer developing time, and this leads to satisfactory development results.

Next, description will be given on the relationship between the minimum developing time and the length of the electrostatic latent image carrier in the moving direction in an effective development area formed between the electrostatic latent image carrier surface and the development electrode in case a plurality of development electrodes are arranged face-to-face to the electrostatic latent image carrier.

FIG. 15 and FIG. 16 schematically illustrate a method for determining minimum time necessary for development. On the electrostatic latent image carrier 40, an electrostatic latent image of positive electric charge is formed, for example, and a rotating roller type development electrode 61 is arranged face-to-face to it with a gap 'd'. The electrostatic latent image carrier 40 is rotated at sufficiently low speed, and a potential higher than the potential on the surface of the electrostatic latent image carrier is applied on the roller type development electrode 61 from a power source E. When the electrostatic latent image surface passes through the development area, the development electrode is grounded by a switch S for a certain period of time. Then, the electrostatic latent image is developed for development time T as shown in FIG. 16. In this case, the minimum time necessary for development is obtained by adjusting the combination of the developer used and the property of the electrostatic latent image carrier so that a reflection density of the developer on the electrostatic latent image carrier surface after development is 1.2 or more.

Description is now given on the process speed and development area when the minimum time necessary for development is obtained in case the electrostatic latent image carrier and the developer are specified.

Figure 17:
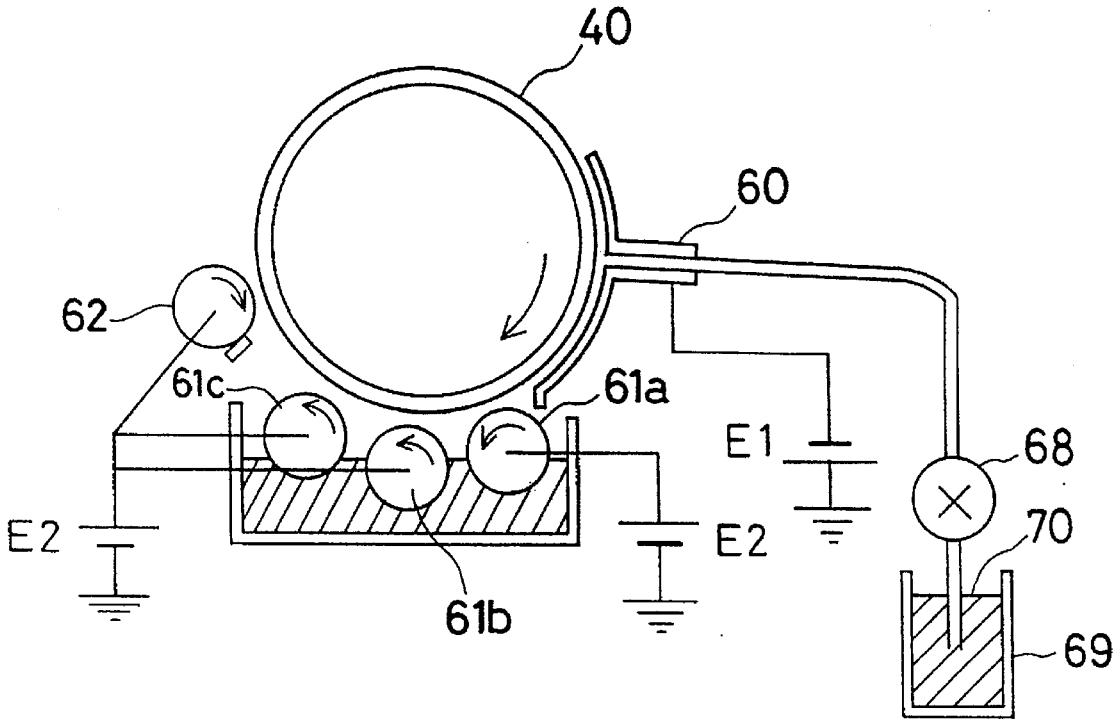
FIG. 17 is a drawing for explaining an embodiment having a plurality of development electrodes.

FIG. 17 shows an embodiment of the liquid development apparatus of the present invention, in which a dish type development electrode 60 and rotating roller type development electrodes 61*a*, 61*b*, and 61*c* are arranged with respect to an electrostatic latent image carrier 40. Bias voltage with opposite polarity to the electrostatic latent image is applied on the dish type development electrode 60, and bias voltage with the same polarity as the electrostatic latent image is applied on the rotating roller type development electrodes. If it is assumed that the moving speed of the electrostatic latent image surface is v, the minimum time necessary for development is t, and the sum of the length of the electrostatic latent image carrier in the direction of moving within an effective development area formed by the electrostatic latent image surface and each of the development electrodes is L, each of the development electrodes is arranged to satisfy the following relationship:

$$L<v\times t \quad (1)$$

By arranging a plurality of the development electrodes to satisfy the relationship (1), minimum development time necessary for development is met. As the result, effective development can be achieved. Also, it is possible to prevent electrodeposition on the development electrodes by selecting the polarity of bias voltage applied to each of the development electrodes, and to prevent the development, i.e. fogging, on the portion of carrier 40 where electrostatic latent image is not formed.

As described above, a plurality of development electrodes are provided and the electrostatic latent image carrier surface is moved over a plurality of development electrodes one after another for development. Thus, the development time can be made longer. The electrodeposition of the development electrodes can be prevented by applying bias voltage of polarity opposite that of the electrostatic latent image to at least one of the development electrodes, and the development on the portion of carrier 40 without the electrostatic latent image can be prevented by applying a bias voltage with the same polarity as the electrostatic latent image on the other development electrodes. In particular, at least one of a plurality of development electrodes is a dish type electrode, bias voltage with opposite polarity to the electrostatic latent image is applied on at least one of the development electrodes, and bias voltage with the same polarity as the electrostatic latent image is applied on the other development electrodes, and a rotating roller type development electrode is used as at least one of the development electrodes, on which bias voltage with the same polarity as the electrostatic latent image is applied. Then, it is possible to make the development time longer by utilizing the features of the dish type development electrode and the rotating roller type development electrodes, and it is also possible to eliminate electrodeposition on development electrodes.

Figure 18:
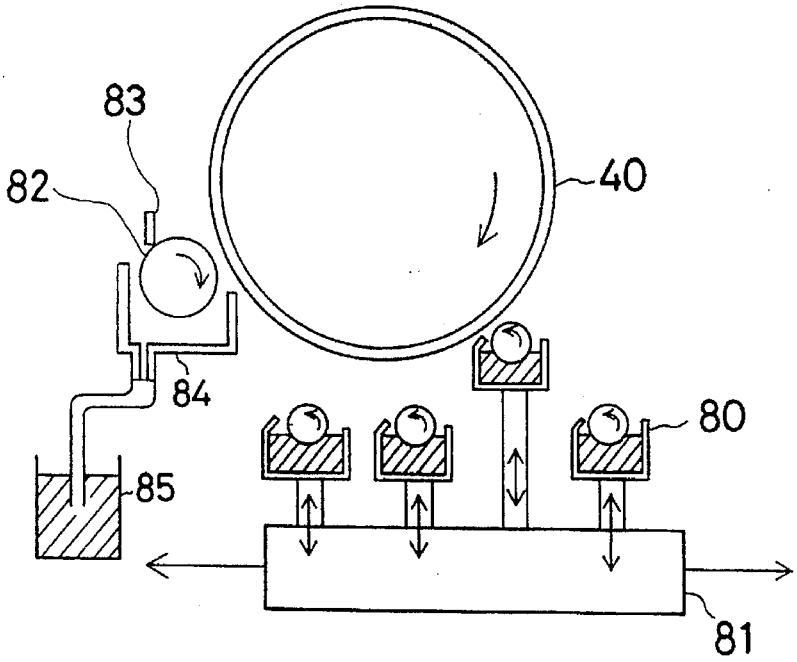
FIG. 18 shows another embodiment of an apparatus having a plurality of development units.

FIG. 18 shows an embodiment of a multicolor development apparatus. In the figure, reference numeral 40 represents an electrostatic latent image carrier, 80 a development unit, 81 a development unit lift, 82 a squeeze roller, 83 a blade, 84 a recovery container, and 85 a container.

The electrostatic latent image carrier 40 is rotated in the direction of the arrow, and an electrostatic latent image is formed on the surface thereof. The development units 80 are provided for 4 colors of Y, M, C and K and are moved up or down in the direction of the arrows by the development unit lift 81 to supply the developing solution of each color to the electrostatic latent image surface. At least one squeezer roller 82 is provided for each color, and it is arranged at a fixed position with respect to the electrostatic latent image carrier 40 to scrape off excessive solvent. The developer on the surface of the squeeze roller 82 can be scraped off by the blade 83. The collected developer is gathered into the recovery container 84 and the container 85. Although not shown in the figure, bias voltage with the same polarity as the electrostatic latent image is applied on the application roller of each development unit to prevent development on the portion of carrier 40 where electrostatic latent image is not formed. Similarly, bias voltage with the same polarity as the electrostatic latent image is applied on the squeeze roller to remove the toner, which was not used for development.

Each development unit 80 is moved up or down with respect to the electrostatic latent image carrier 40 in programmed sequence by the development unit lift 81, and full-color development is performed by multicolor superimposing development, and excessive solvent is collected by the squeeze roller 82. Each development unit and the squeeze roller are independently arranged, and only the development units can be moved, and the squeeze rollers commonly used for each color are disposed at fixed positions. As the result, the entire development apparatus can be designed in compact form, and it is possible to keep a constant distance between the squeeze roller and the electrostatic latent image carrier.

Figure 19:
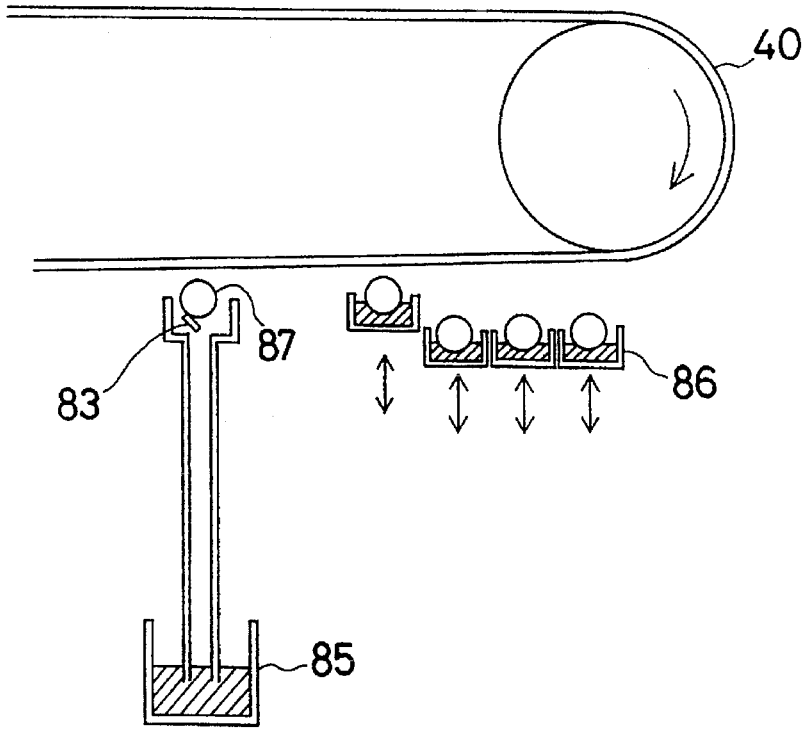
FIG. 19 shows another embodiment of an apparatus having a plurality of development units.

FIG. 19 shows another embodiment of the multicolor development apparatus. In this embodiment, the electrostatic latent image carrier 40 is not of a rotating drum type but is in sheet form. The multicolor development units 86 move independently for each color, and each developing solution is supplied to the electrostatic latent image surface. The squeeze roller 87 for scraping off excessive solvent is installed commonly for each color. Thus, as in the case of FIG. 18, it is possible to design the development apparatus in compact form and to easily set the distance between the squeeze roller and the electrostatic latent image carrier.

As described above, the development apparatus and excessive solvent recovery unit are arranged separately and independently. The development apparatus is designed as a movable unit for each color, and the recovery unit is arranged at a fixed position commonly used for each color. Thus, it is possible to design the development apparatus in compact form and to easily keep a constant distance between the recovery unit and the electrostatic latent image carrier surface.

Figure 25:
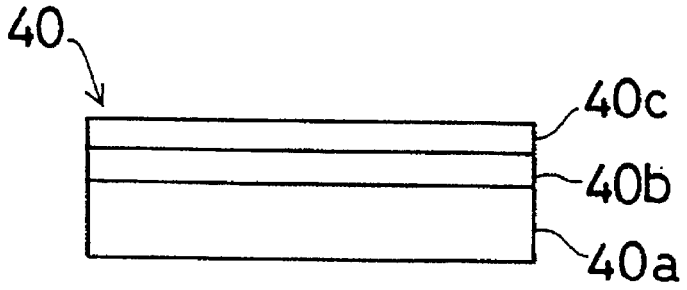
FIG. 25 shows a layer structure of the electrostatic latent image carrier of the present invention.
Figure 26:
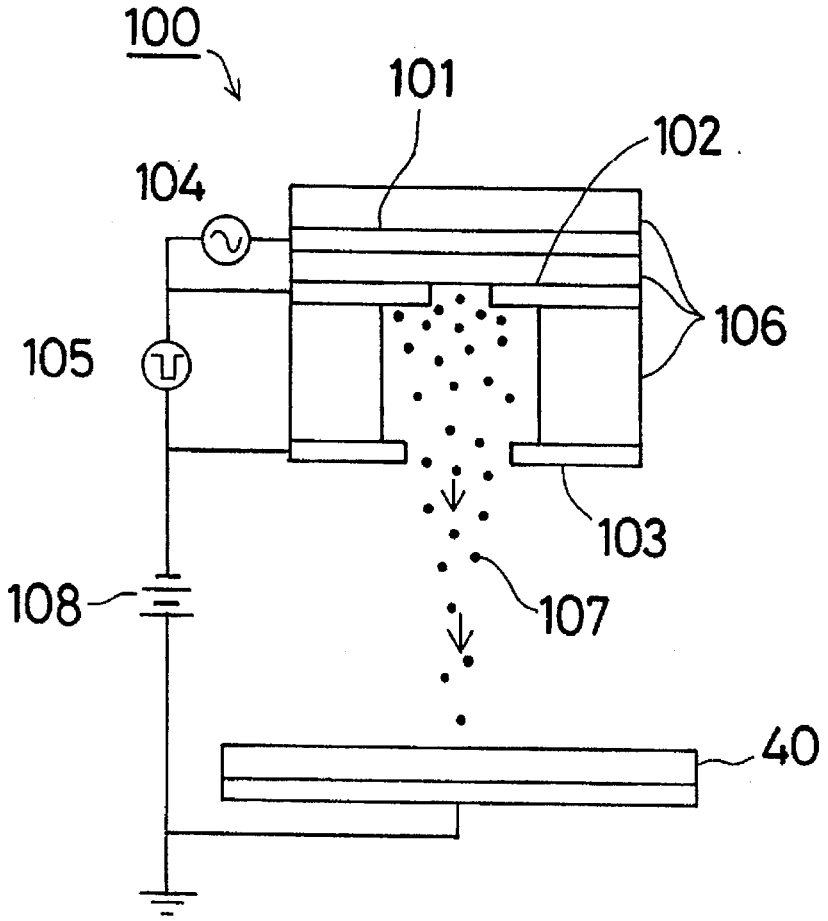
FIG. 26 shows an example of a solid discharge type ion printer.

As the electrostatic latent image carrier in the above embodiments, the following may be used: a photosensitive member having photoconductive layer, electrostatic recording paper, or a support member 40*a* shown in FIG. 25 with a conductive member 40*b* and a dielectric member 40*c* laminated on it one over the other. To form an electrostatic latent image, there are: methods employing image exposure, and printer type methods employing an ion flow control type printer such as a solid discharge type ion printer as shown in FIG. 26, and a colotron discharge type ion printer as shown in FIGS. 27(*a*)–27(*b*).

Figure 20:
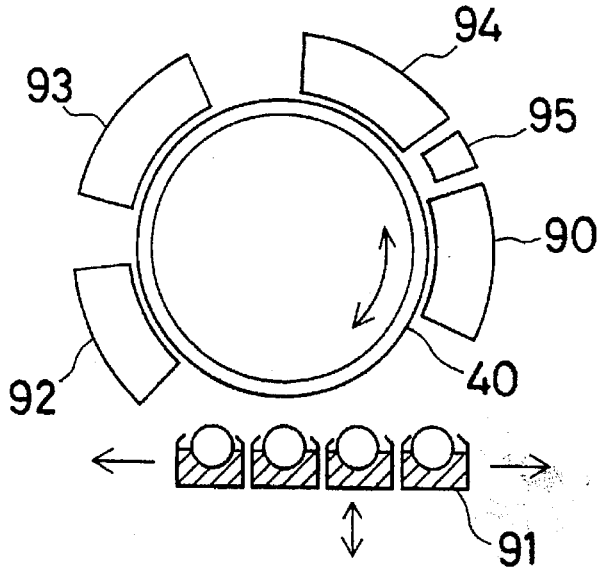
FIG. 20 shows an arrangement of a multicolor liquid development and transfer apparatus.
Figure 21:
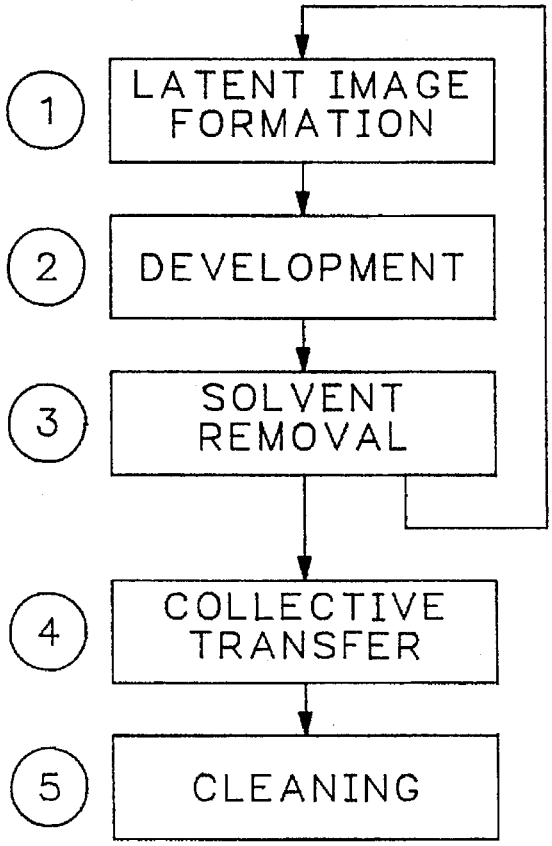
FIG. 21 shows a process of liquid development and transfer.

FIG. 20 represents an arrangement of a multicolor liquid development and transfer apparatus, and FIG. 21 shows liquid development and transfer process. In the figures, reference numeral 40 represents an electrostatic latent image carrier, 90 a latent image forming unit, 91 a liquid development unit, 92 a solvent remover, 93 a transfer unit, 94 a cleaning unit, and 95 a de-energizing unit.

An electrostatic latent image is formed on the electrostatic latent image carrier 40 by a latent image forming unit 90, and the carrier is rotating in the direction of the arrow as shown. A wet type development unit 91 is a developing device equipped with units for each color that move and supply developing solutions for each color to the electrostatic latent image surface. The solvent remover 92 comes close to the electrostatic latent image carrier 40 and scrapes off or dries excessive solvent. The transfer unit 9B is to transfer the developer layer with multiple development, and the cleaning unit 94 cleans up the developer layer, which was not transferred. The deenergizing unit 95 de-energizes the latent image charge remaining in the electrostatic latent image carrier 40.

When multicolor liquid development and transfer are performed in the above arrangement, formation of latent image, development, and solvent removal (steps (1), (2) and (3)) are carried out one after another for each color. Heating may be performed at the same time as solvent removal. Solvent is removed for each color, and no mixing of colors occurs. Then, in step (4), the image is transferred together to the recording paper which may include an intermediate transfer medium. In step (5), cleaning is carried out to prepare for the next development.

As the electrostatic latent image carrier of FIG. 20, a photosensitive member having a photoconductive layer, an electrostatic recording paper, or a support member 40*a* shown in FIG. 25 with conductive member 40*b* and dielectric member 40*c* laminated on it one after another may be used. To form the electrostatic latent image, a method of image exposure may be used, or ion flow control type printing employing a printer such as the solid discharge type ion printer of FIG. 26 or the colotron discharge type ion printer as shown in FIGS. 27(*a*)–27(*b*).

When an electrostatic latent image is formed on the photosensitive member or dielectric member layer by an ion flow control type printer, even when there is already a previously developed developer layer, a latent image of another color can be formed with less intercolor influence as compared with methods employing light exposure such as a laser using a photoconductive layer, and multicolor superimposing development can be achieved with high accuracy. When the photosensitive member is used, it is possible to de-energize the photosensitive member by uniform exposure. If a dielectric member is used, it is possible to increase stability of the electrostatic latent image and mechanical strength of the carrier.

As shown in FIG. 21, after development has been performed for each color, solvent contained in the developed image layer is removed. Or, after heating, color superimposing development is performed, and the image is then transferred to the recording paper or to the intermediate transfer medium, and this contributes to the prevention of mixing of colors of the developing solutions.

Figure 22:
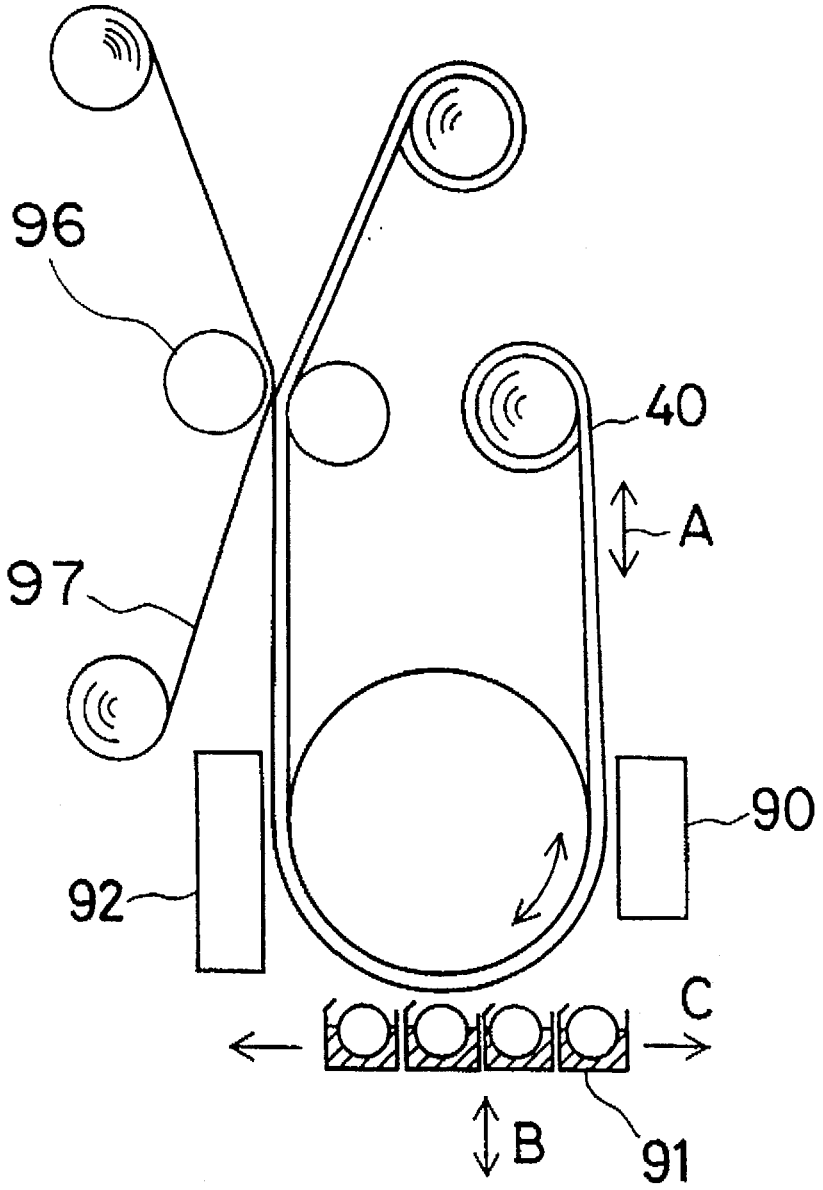
FIG. 22 shows an embodiment of a collective transfer system.

FIG. 22 shows an electrostatic latent image carrier 40, which is not of a rotating drum type but in the form of a long sheet. Electrostatic latent image is formed by an electrostatic latent image forming unit 90 for each color. To match this, a liquid development unit 91 is moved in the directions of arrows C and arrows B. Then, excessive solvent is removed by the solvent remover 92 or it is heated further. The electrostatic latent image carrier is turned back, and formation of electrostatic latent image, development and solvent removal are performed for the other colors. The electrostatic latent image carrier 40 is reciprocally moved for repeatedly performing latent image formation, development, and solvent removal. Then, the image is collectively transferred to the recording paper 97 by a collective transfer means 96. After the transfer process, the electrostatic latent image carrier is wound up without cleaning processing in the present embodiment, and the next transfer is performed.

Figure 23A:
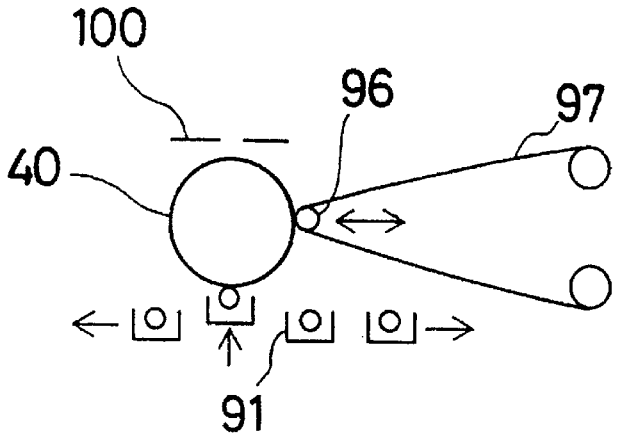
FIG. 23(*a*)–23(*c*) shows another embodiment of the transfer system.
Figure 23B:
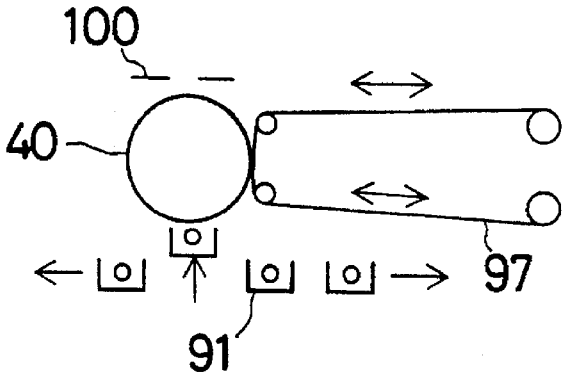
Figure 23C:
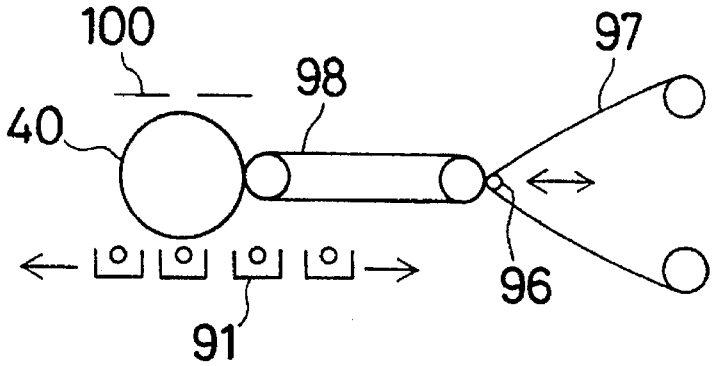
Figure 24A:
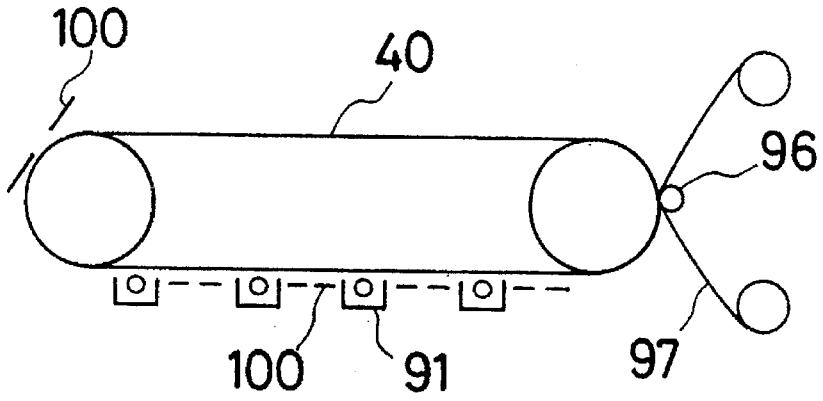
FIG. 24(*a*)–24(*c*) represents another embodiment of the transfer system.
Figure 24B:
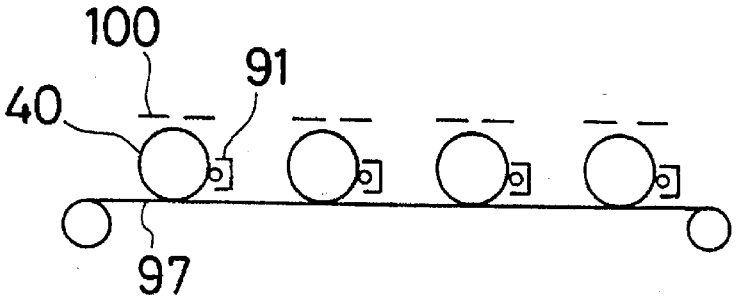
Figure 24C:
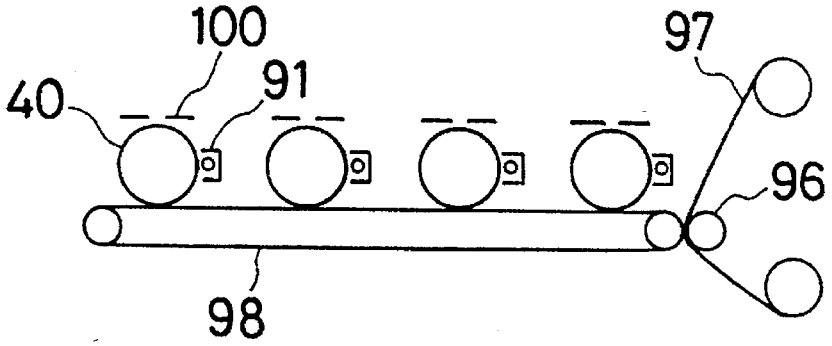

Next, a description is given of an example of a full-color 4-color transfer system referring to FIG. 23 and FIG. 24. In the following, no description is given as to the solvent remover and the cleaning unit, and the processes of the latent image formation, development and transfer are the same as explained hereinbefore with reference to FIG. 20 and FIG. 21.

In FIG. 23 (*a*), latent image for each color is formed on an electrostatic latent image carrier 40 a rotating drum type by an ion printer 100. The image is developed by a liquid development unit 91 and color superimposing development is performed on the surface of the electrostatic latent image carrier 40, and the image is transferred on the recording paper 97 by a collective transfer means 96. It is needless to say that the processes of latent image formation, development and solvent removal are repeatedly performed for each color when color superimposing development is carried out.

In FIG. 23 (*b*), the recording paper 97 is moved back and forth for repeatedly performing the processes of latent image formation, development and solvent removal for each color, and the images are transferred one after another.

Figure 1:
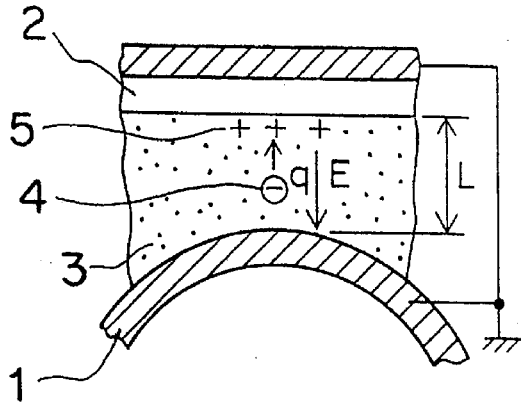
FIG.1 (PRIOR ART)
FIG. 1 is a drawing for explaining a wet type development method.
Figure 2:
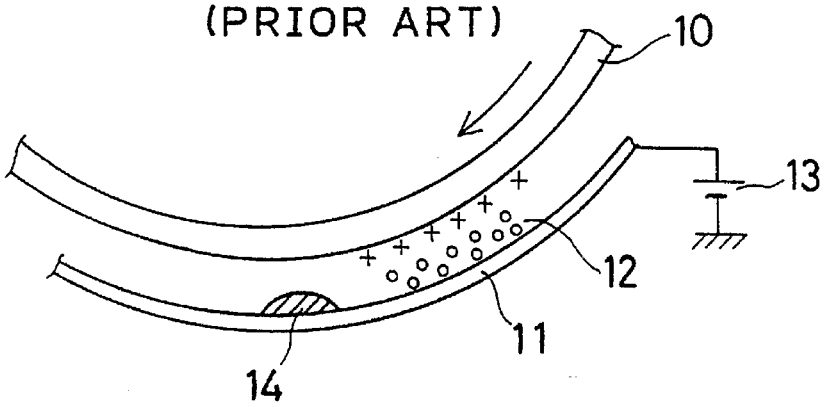
FIG.2 (PRIOR ART)
FIG. 2 is a drawing for explaining a development apparatus with a dish type development electrode.
Figure 3:
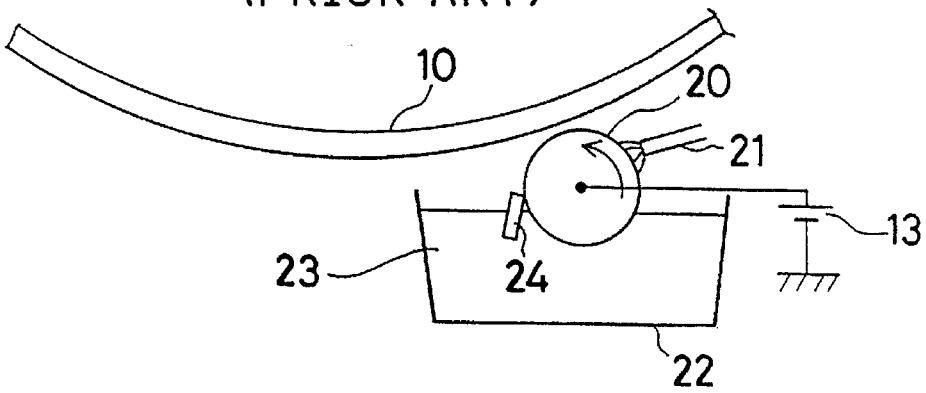
FIG.3 (PRIOR ART)
FIG. 3 is a drawing for explaining a development apparatus using a roller type electrode.
Figure 4:
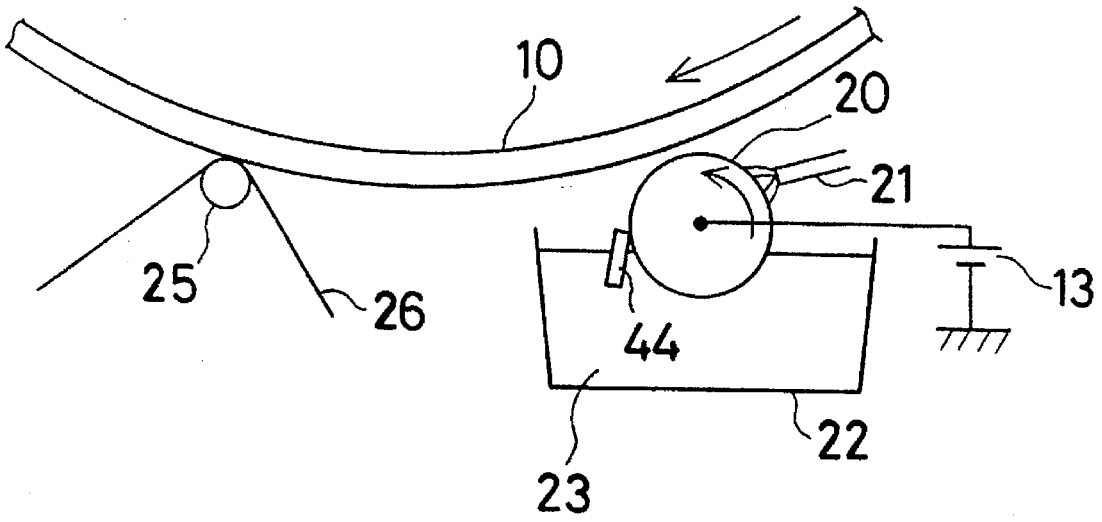
FIG.4 (PRIOR ART)
FIG. 4 shows an example of a development and transfer apparatus using a roller type electrode.
Figure 5:
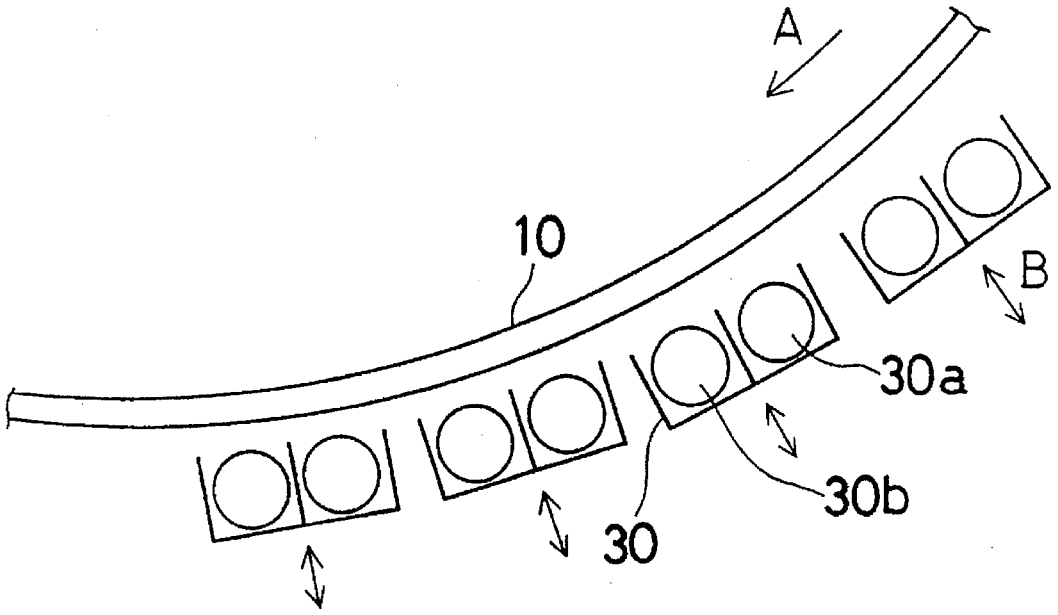
FIG.5 (PRIOR ART)
FIG. 5 is a drawing of a conventional type multicolor liquid development apparatus using development rollers.

The arrangement in FIG. 2B (*c*) is different from FIG. 2B (*a*) in that an intermediate transfer medium 98 is placed between the electrostatic latent image carrier 40 and the recording paper 97. For each color, the processes of latent image formation, development, solvent removal, transfer to the intermediate transfer medium 98, and cleaning are repeated. Color superimposing is performed on the intermediate transfer medium 98, and the image is collectively transferred to the recording paper 97 by the collective transfer means 96.

In the arrangement of a FIG. 24(*a*), an electrostatic latent image carrier 40 of belt type is used. On this electrostatic latent image carrier, the processes of electrostatic latent image formation, development and solvent removal are repeated for color superimposing development, and this is collectively transferred onto the recording paper 97 by the collective transfer means 96. To form latent image on the electrostatic latent image carrier 40 of belt type, an ion printer 100 may be arranged for each color, or an ion printer for common use may be furnished.

In the arrangement of FIG. 24 (*b*), a drum type electrostatic latent image carrier, a wet type development unit, and an ion printer 100 are arranged for each color. The image is transferred directly onto the recording paper 79 for each color, and color superimposing is performed on the recording paper.

The arrangement in FIG. 24 (*c*) differs from FIG. 24 (*b*) in that a intermediate transfer medium 98 is disposed, and the image is transferred collectively onto the recording paper 97 by a collective transfer means 96. In this embodiment, development is performed for each color for each of the electrostatic latent image carriers 40, and color superimposing is performed on the intermediate transfer medium 98.

Next, the advantages of collecting transfer and the use of liquid developer in collective transfer will be described.

(1) Advantage of collective transfer

In case the respective images are transferred directly to paper for each color, the accuracy of color superimposing is decreased depending upon the accuracy of expansion or contraction of paper or paper feeding. In contrast, color superimposing accuracy can be increased by instead superimposing the separate images of the 4 colors of Y, M, C and Bk on a dielectric drum, belt or intermediate transfer medium under mechanical or electrical control.

(2) Advantage of liquid developer

Dry type developer is made of powder material. When an electrostatic latent image has been developed by toner of a certain color, powder is scattered all over the dielectric member. When an attempt is made to form an image with the second color, insufficient smoothness (surface irregularities) of toner surface on the dielectric member or the presence of voids in toner layer adversely affect the formation of the electrostatic latent image of the second color, and this hinders preparation of a satisfactory image. Similarly, more influence is exerted on the formation of an image of the third color and thereafter.

To avoid this problem, it is necessary to smoothen and to eliminate voids on the dielectric member for each color by means such as a heating roll. In such case, however, the dielectric member of the carrier and the toner are more closely and firmly stuck to each other, and this leads to extreme reduction of transfer efficiency in the process of transfer to paper, and it is also difficult to clean up the toner remaining on the dielectric member.

In contrast, liquid developer performs electrophoretic movement in carrier solution. Since particle size is smaller than dry type developer, almost no voids are generated when an electrostatic latent image is developed. When excessive toner in the development process is removed by squeeze roller or by negative pressure, the toner layer is turned to a film-like state with perfect smoothness. This reduces the influence On the formation of a subsequent electrostatic latent image of the second color and thereafter.

Means for supplying hot air for drying carrier solution may be provided between the processes of the first color, the second color, etc.

Next, a description is given on the advantage of the use of an intermediate transfer medium in the collective transfer.

In designing the dielectric material, especially, the dielectric material for obtaining multicolor print, it is necessary to consider electrical, physical and mechanical properties including the properties of writing device such as ion head, development properties of toner, transfer properties of toner and various types of paper. The toner itself must have the same dielectric constant, voltage holding property, interfacial property, etc. as in the writing development of electrostatic latent image on electrostatic recording paper.

In contrast, the use of an intermediate transfer medium has made it possible to isolate the functionality required of the dielectric material from that of the toner, thus widening the scope of material selection and optimizing process parameters. Particularly in the case of toner, it is also possible to expand the scope of design.

As described above, after development is performed for each color, solvent contained in the developed image layer is removed or heated, and color superimposing development is performed. Then, the image is collectively transferred to the recording paper or the intermediate transfer medium. This makes it possible to prevent mixing of colors in the developing solution of each color. If the electrostatic latent image carrier with dielectric layer and conductive layer laminated is used, there is no influence from the previously developed layer, and color superimposing development can be performed on the dielectric layer, and multicolor superimposing development can be performed with high accuracy.

FIG. 25 represents an example of an electrostatic latent image carrier in the above embodiments, in which a conductive member 40*b* and a dielectric member 40*c* are laminated on a support member 40*a*.

FIG. 26 is a drawing for explaining the recording principle of a solid discharge type ion printer used as an example of ion flow control printer. Between a line electrode 101 and a finger electrode 102 arranged with an insulating body 106 between them, a signal of high frequency i.e. several MHz and of high voltage, i.e. several kV, is applied to generate discharge in the head. The direction of electric field between the finger electrode 102 and the screen electrode 103 is controlled by an image signal 105, and ions 107 generated by discharge are selectively taken out, and an electrostatic latent image is formed on the electrostatic latent image carrier 40.

FIGS. 27(*a*)–27(*b*) illustrate the recording principle of a colotron discharge type ion printer. In the figure, reference numeral 40 represents a recording medium, 111 a corona ion generating source, 112 an upper opening electrode, 113 an insulating layer, 114 a lower opening electrode, 115 a hole, 117 a power source for a corona ion generation, 118 and control signal power sources, and 119 is a bias power source.

The corona ion generating source 111 is, for example, a casing electrode 111*a* with a corona wire 111*b* stretched in it, and corona ions are generated by applying high DC voltage from the power source 117 for corona ion generation between the casing electrode 111*a* and the corona wire 111*b*. Each of the upper and the lower opening electrodes 112 and 114 formed on two sides of the insulating layer 113 has an opening to match a hole 115 formed on the insulating layer and forms a unit recording element. Ion flow is placed under ON/OFF control according to the polarity of control signal voltage applied from the control signal power sources 118 and 119. Passing through the hole of the insulating layer, corona ions are guided by the electric field, which is formed between the recording medium 40 by the bias power source 119, and latent image is formed on the recording medium 40.

In the above arrangement, when a signal voltage is applied in such manner that the upper opening electrode 112 is turned positive with respect to the lower electrode 114 as shown in FIG. 27(*a*) corona ions flow toward the recording medium 40 along the electric field formed in the electrode opening, and a latent image is formed. On the other hand, when the signal voltage is applied in such manner that the polarity of signal power source is reversed, an electric field is formed in the electrode opening in such direction so as to hinder ion flow, and ions cannot pass through the opening. Thus, a latent image corresponding to the control signal is formed on the recording medium 40.

What is claimed is:

1. A liquid development apparatus for electrostatic latent image, comprising an electrostatic latent image carrier where an electrostatic latent image having an unchanging polarity is formed and a plurality of development electrodes are arranged face-to-face to the electrostatic latent image carrier, wherein bias voltage with opposite polarity to the electrostatic latent image is applied on at least one of said plurality of development electrodes, and bias voltage with the same polarity as the electrostatic latent image is applied on the other development electrodes, wherein at least one of said plurality of development electrodes is a dish type development electrode, and bias voltage with opposite polarity to the electrostatic latent image is applied on at least one of the dish type development electrodes.

2. A liquid development apparatus for electrostatic latent image according to claim 1, wherein bias voltage is applied on at least one of said plurality of development electrodes, and at least one of the development electrodes is a rotating roller type development electrode.

3. A liquid development apparatus according to claim 1, wherein said apparatus is a multicolor liquid development and transfer apparatus and wherein the electrostatic latent image is formed on the electrostatic latent image carrier by an ion printer.

* * * * *